US011021668B2

(12) United States Patent
Willis

(10) Patent No.: US 11,021,668 B2
(45) Date of Patent: Jun. 1, 2021

(54) FUEL SOURCE SHAVING DEVICE AND METHOD(S) OF USE

(71) Applicant: Chris D. Willis, Colorado Springs, CO (US)

(72) Inventor: Chris D. Willis, Colorado Springs, CO (US)

( * ) Notice: Subject to any disclaimer, the term of this patent is extended or adjusted under 35 U.S.C. 154(b) by 294 days.

(21) Appl. No.: 16/239,469

(22) Filed: Jan. 3, 2019

(65) Prior Publication Data

US 2019/0203136 A1 Jul. 4, 2019

Related U.S. Application Data

(60) Provisional application No. 62/613,252, filed on Jan. 3, 2018.

(51) Int. Cl.

| | |
|---|---|
| ***C10L 11/00*** | (2006.01) |
| ***C10L 11/08*** | (2006.01) |
| ***B26D 3/28*** | (2006.01) |
| ***C06C 15/00*** | (2006.01) |
| ***F23Q 1/00*** | (2006.01) |
| ***C22C 38/00*** | (2006.01) |
| *C22C 23/00* | (2006.01) |
| *B26D 1/02* | (2006.01) |

(52) U.S. Cl.

CPC ..... *C10L 11/08* (2013.01); *B26D 3/282* (2013.01); *C06C 15/00* (2013.01); *C22C 38/00* (2013.01); *F23Q 1/00* (2013.01); *B26D 1/02* (2013.01); *C22C 23/00* (2013.01); *C22C 38/005* (2013.01)

(58) Field of Classification Search

CPC ..... C10L 11/08; B26D 3/282; B26D 1/02; C06C 15/00; C22C 38/00; C22C 23/00; C22C 38/005; F23Q 1/00

See application file for complete search history.

(56) References Cited

U.S. PATENT DOCUMENTS

| | | | | |
|---|---|---|---|---|
| 4,698,068 | A | 10/1987 | Jensen | |
| 5,279,628 | A | 1/1994 | Hutchens | |
| 5,919,037 | A | 7/1999 | Brillhart | |
| 6,397,479 | B1 * | 6/2002 | Luttgens | B43L 23/08 144/28.11 |
| 8,186,995 | B2 * | 5/2012 | Putrello, Jr. | F23Q 1/06 431/273 |
| D679,141 | S * | 4/2013 | Slack | D7/416 |
| 9,506,650 | B2 | 11/2016 | Abrahamer | |
| 9,732,959 | B2 | 8/2017 | Holland | |
| D864,295 | S * | 10/2019 | Eisen | D19/73 |
| 10,684,011 | B2 * | 6/2020 | Seitier, Jr. | A45C 13/008 |
| 2015/0226429 | A1 * | 8/2015 | Holland | F23Q 1/06 431/274 |

FOREIGN PATENT DOCUMENTS

| | | |
|---|---|---|
| CN | 110525095 | * 12/2019 |
| WO | 2017165905 | 10/2017 |

* cited by examiner

*Primary Examiner* — Alfred Basichas

(74) *Attorney, Agent, or Firm* — Leyendecker & Lemire, LLC

(57) ABSTRACT

A fuel source shaving device and method(s) of use is described. Embodiments of the fuel source shaving device can include, but is not limited to, a housing, a blade, and a bore passing through the housing. The fuel source shaving device can be implemented to create ribbons and/or shavings of material from a fuel source to aid in starting a fire.

9 Claims, 6 Drawing Sheets

FUEL SOURCE SHAVING DEVICE AND METHOD(S) OF USE

CROSS-REFERENCE TO RELATED APPLICATION

This application claims the benefit of U.S. Provisional Application No. 62/613,252, filed Jan. 3, 2018.

BACKGROUND

Currently available ferro strikers provide only enough energy, spark output, to get something flammable ignited. For instance, ferro strikers are commonly used in conjunction with alcohol, petrol jelly, lighter fluid, a propane source, etc. In order to generate enough heat to make poor tinder ignite and burn, you need more heat source, ferro shavings, and/or sparks.

Ribbons of a ferro rod can burn for approximately 10-15 seconds at approximately 3000° C. (5500° F.). The ribbons of the ferro rod can turn into a pile of molten metal. Currently available devices for creating ribbons of material from a ferro rod typically include stainless steel components that are too soft and catastrophically lose their edge after only a few interactions with a ferro rod.

The overall idea for using poor, but burnable, tinder is to get rid of the moisture in the tinder and get the flammable materials of choice to take flame. Ribbons of a ferro rod run the potential to get otherwise unusable materials to promote a flame due to the long burn time and static storage effect of the ferro rod.

As such, there is a need for a device that can harvest ribbons of ferrocerium from a ferro rod for use in starting a fire in survival situations.

DETAILED DESCRIPTION

Figure 1:
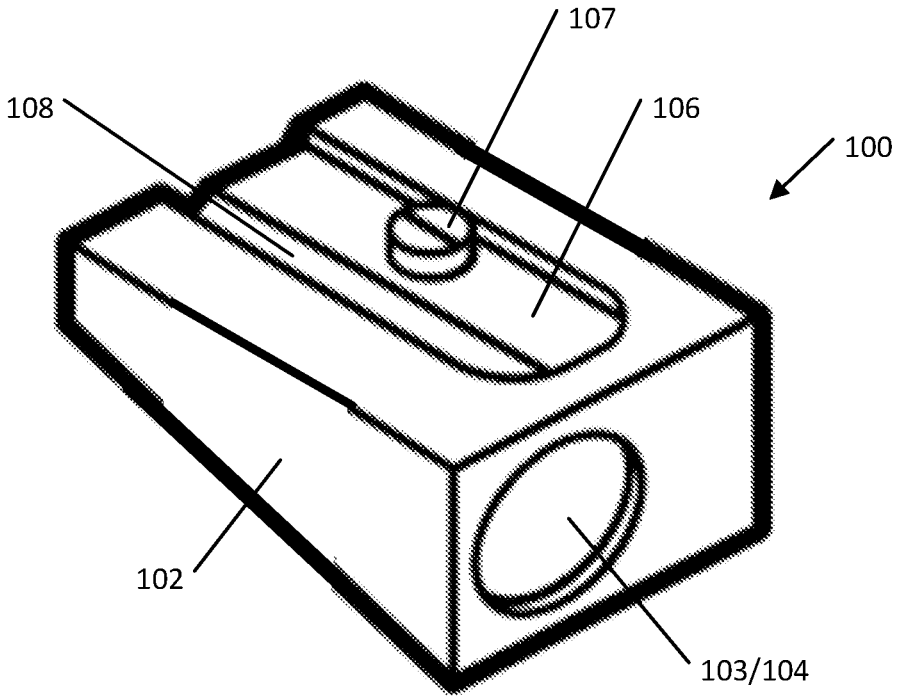
FIG. 1 is a perspective view of a fuel source shaving device according to one embodiment of the present invention.

Embodiments of the present invention include a fuel source shaving device and method(s) of use for manipulating a fuel source. Typically, the device can be implemented to create ribbons of material from a fuel source having a substantially cylindrical shape, for example a rod. In some embodiments, the device can be implemented to create fine shavings of material. Of note, a purpose of the device can be altered based on a type of blade included with the device.

For instance, the device can be implemented to create ribbons of ferrocerium from a ferrocerium rod. In another instance, the device can be implemented to create shavings of magnesium from a magnesium rod. In both instances, the rods can be rotated against a fixed blade of the device, with a design of the fixed blade determining if ribbons or shavings are created. In some embodiments, the device can include both a blade sharpened on one edge and a blade having a serrated edge.

In one embodiment, the device can include a housing, a tapered bore in the housing, and a blade located partially in the tapered bore. Of note, the blade can be angled inside the bore to follow a pitch of the tapered bore. For instance, a first end of the blade can be located closer to an outside edge of the housing and a second end can be located more towards a middle of the housing. The blade can generally be manufactured from hardened steel (e.g., S7 tool steel) that has a Rockwell rating of 60 or similar rating. Of note, an angle formed between a surface of a rod inserted into the device and the blade can be approximately 15 to 90 degrees.

In a typical implementation, a ferrocerium rod can be inserted into and rotated inside the bore of the device. As the rod is rotated, the blade can be used to cut a ribbon of material off of an outer surface of the rod. Of note, another opening or slot can be located proximate a length of the blade to allow the ribbon to exit the housing.

In another embodiment, the device can include a housing, a tapered bore, and a blade having a serrated edge and surface. The serrated edge and surface can be implemented to create shavings of material from a rod inserted into and rotated against the serrated blade. In such an embodiment, the device can include a cap (or collection chamber) proximate an end of the device such that the shavings may be collected in the cap. As can be appreciated, the shavings may then be dispersed when needed. In some instances, the shavings can be stored in the cap for use at a later time.

In some embodiments, the device can be part of a kit including a rod of combustible material and a housing for the rod of combustible material. Of note, the housing for the rod can be implemented as a handle and/or a storage container. The housing can provide protection for the rod from the elements when not in use. In some embodiments, each of the components can be threadably coupled to each other. For instance, the device can be a cap for the housing and threadably couple to a first end of the housing. The combustible material rod can be threaded on one end to threadably engage a second end of the housing. To use the kit, each of the components can be disengaged from the housing and the combustible material rod can be inserted into and rotated against a blade of the device.

In one embodiment, the previously mentioned kit can further include a collection chamber configured to capture and store shavings, ribbons, etc. from the device as a fuel source rod is rotated inside the device.

In one embodiment, a method of implementing a fuel source shaving device for shaving a ferrocerium rod can include the following steps. In a first step, a fuel source shaving device can be provided. The fuel source shaving device can include, but is not limited to, a housing, a substantially cylindrical bore in the housing, and a hardened steel blade coupled to the housing. An edge of the hardened steel blade can project into the substantially cylindrical bore. In a second step, a ferrocerium rod can be inserted into the substantially cylindrical bore. In a third step, the ferrocerium rod can be rotated causing the hardened steel blade to interface with the ferrocerium rod. In a fourth step, at least one ribbon of ferrocerium can be procured. In a fifth step, the at least one ribbon of ferrocerium can be used as a fuel source to help start a fire.

In another embodiment, a method of implementing a fuel source shaving device for shaving a magnesium rod can include the following steps. In a first step, the fuel source shaving device can be provided. The fuel source shaving device can include, but is not limited to, a housing, a substantially cylindrical bore in the housing, and a hardened steel blade having a serrated edge coupled to the housing. The serrated edge of the hardened steel blade can project into the substantially cylindrical bore. In a second step, a magnesium rod can be inserted into the substantially cylindrical bore. In a third step, the magnesium rod can be rotated causing the serrated edge of the hardened steel blade to interface with the magnesium rod. In a fourth step, fine shavings of magnesium can be procured from the magnesium rod. In a fifth step, the fine shavings of magnesium can be used as a fuel source to help start a fire.

In yet another embodiment, a method of implementing a fuel source shaving device can include the following steps. In a first step, a fuel source shaving device can be provided. The fuel source shaving device can include, but is not limited to, a housing, a first substantially cylindrical bore in the housing, a first hardened steel blade having a serrated edge coupled to the housing where the serrated edge of the hardened steel blade projects into the first substantially cylindrical bore, a second substantially cylindrical bore in the housing, and a second hardened steel blade coupled to the housing where an edge of the hardened steel blade projects into the second substantially cylindrical bore. In a second step, a magnesium rod can be inserted into the first substantially cylindrical bore. In a third step, the magnesium rod can be rotated causing the serrated edge of the hardened steel blade to interface with the magnesium rod. In fourth step, fine shavings of magnesium can be procured. In a fifth step, a ferrocerium rod can be inserted into the second substantially cylindrical bore. In a sixth step, the ferrocerium rod can be rotated causing the hardened steel blade to interface with the ferrocerium rod. In a seventh step, at least one ribbon of ferrocerium can be procured. In an eighth step, the fine shavings of magnesium and the at least one ribbon of ferrocerium can be used as a fuel source to help start a fire.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

Embodiments of a Fuel Source Shaving Device and Methods of Use

Referring to FIG. 1, a detailed diagram of a first embodiment 100 of a fuel source shaving device is illustrated. As shown, the device 100 can appear similar to a standard prism pencil sharpener.

Typically, the device 100 can include, but is not limited to, a housing 102, a conical shaped aperture (or bore) 104, and a blade 106. The blade 106 of the fuel source shaving device 100 can be manufactured from a hardened steel. For instance, the blade 106 can be a hardened steel blade adapted to shave ribbons of material from a ferrocerium rod.

As shown, the fuel source shaving device housing 102 can be a small rectangular prism or block. The block housing 102 can include a circular opening 103 for the cone shaped or conical bore 104.

The circular opening 103 of the cone shaped bore 104 can be sized such that a fuel source rod can be inserted into the cone shaped bore 104 via the circular opening 103. The hardened steel blade 106 can be mounted such that a sharp edge of the blade 106 enters a minimal distance into and tangentially to the cone shaped bore 104. The blade 106 can be fixed in place such that when a fuel source rod is inserted into the cone shaped bore 104, the blade 106 remains static as the fuel source rod is rotated. In one instance, the blade 106 can be fixed to the housing 102 via a fastener 107. In another instance, the blade 106 can be more permanently fixed to the housing 102. For example, a rivet may be implemented to secure the blade 106 to the housing 102.

In some embodiments, the housing 102 can be ergonomically contoured or can include a ridged or grooved surface to make the housing easier to firmly grip. Typically, the housing 102 can be manufactured from a rigid material including, but not limited to, an aluminum alloy, magnesium alloy, stainless steel, steel alloy, or a rigid plastic. An edge of the blade 106 inside the housing 102 can be implemented to shave the fuel source rod, while any shavings or ribbons of material may emerge through a slot 108 along an edge of the blade 106.

Figure 2:
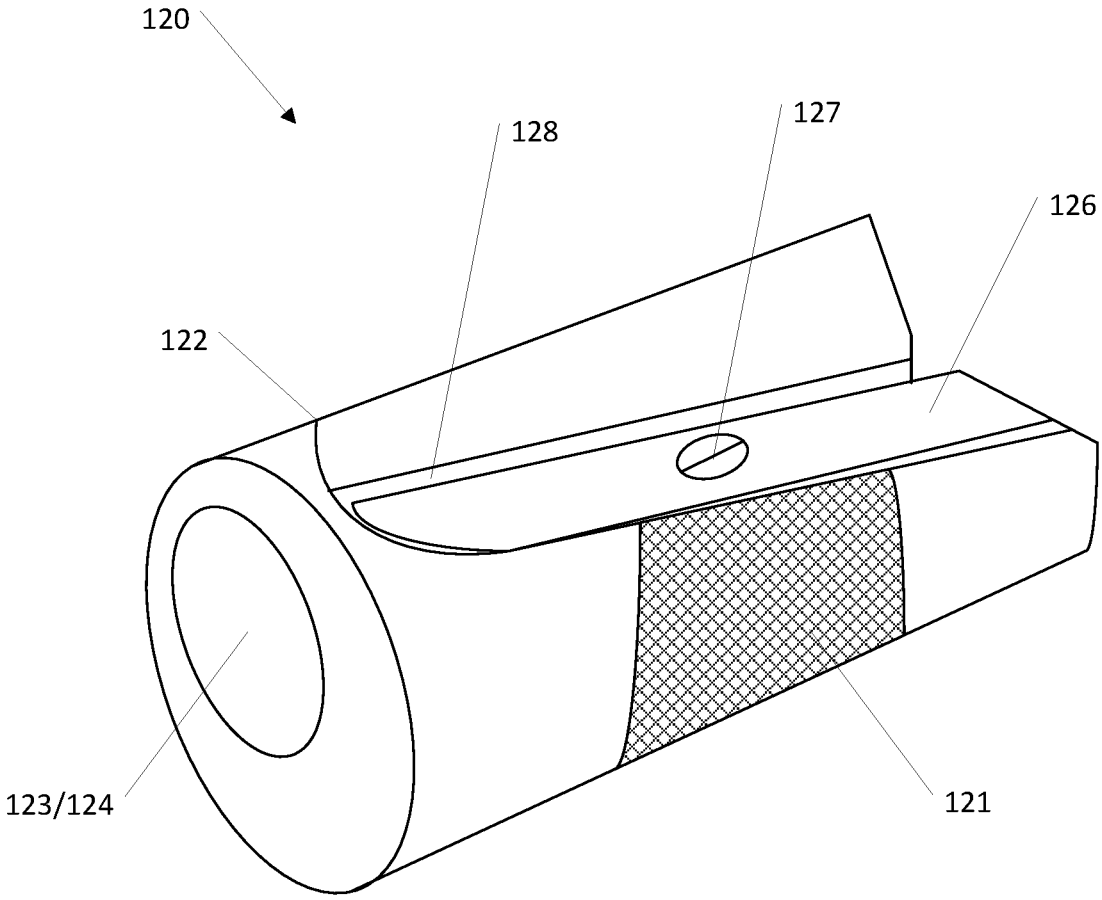
FIG. 2 is a perspective view of a fuel source shaving device according to one embodiment of the present invention.

Referring to FIG. 2, a second embodiment 120 of a fuel source shaving device is illustrated. As shown, the second embodiment fuel source shaving device 120 can include components similar to the first embodiment fuel source shaving device 100.

Typically, the second embodiment fuel source shaving device 120 can include, but is not limited to, a housing 122, a cone shaped aperture (or bore) 124, and a blade 126. The device 120 can include a substantially circular opening 123 similar to the first embodiment fuel source shaving device 100. The device 120 may further include a slot 128 proximate the blade 126 to allow for shaved material to exit the housing 122. In one embodiment, the blade 126 may be removably coupled to the housing 122 via a fastener 127. For instance, a screw may be implemented to removably couple the blade 126 to the housing 122.

As shown, the housing 122 can be more cylindrical and can include a ridged surface 121 for gripping the fuel source shaving device 120. In one embodiment, a distal end of the housing 122 can be threaded to couple to another housing, described hereinafter.

Figure 3A:
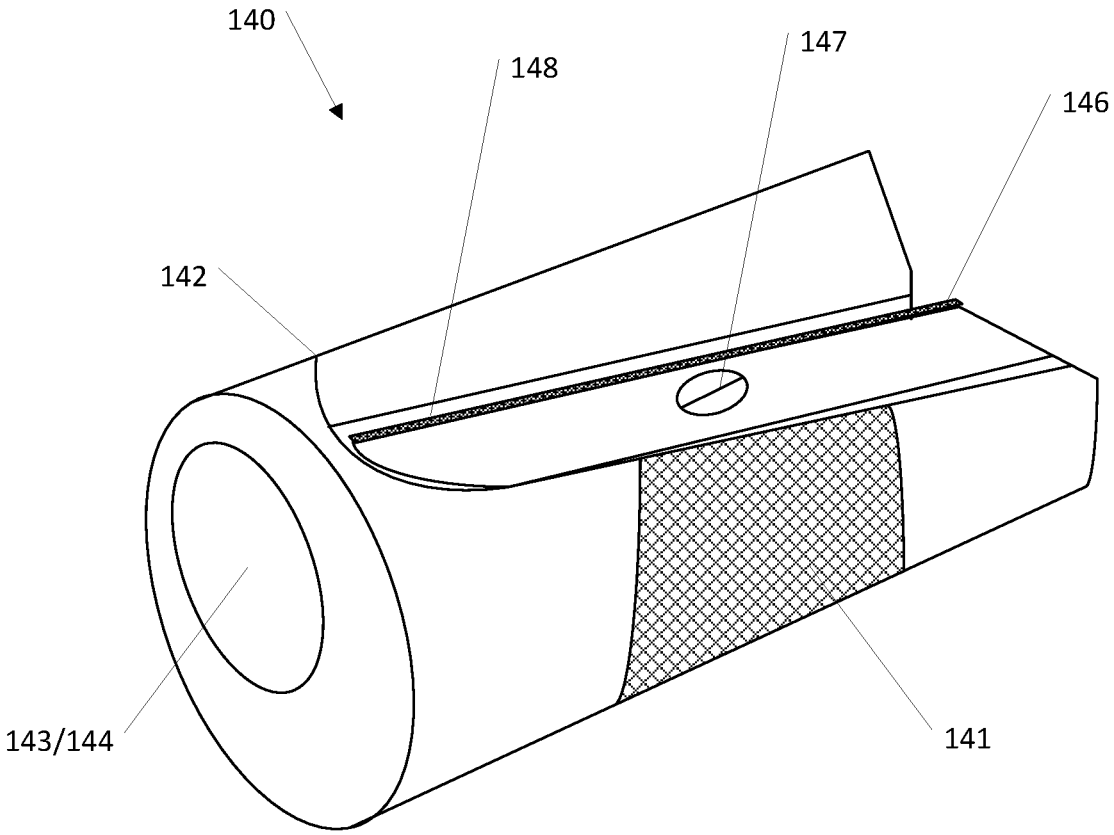
FIG. 3A is a perspective view of a fuel source shaving device according to one embodiment of the present invention.

Referring to FIG. 3A, a third embodiment of a fuel source shaving device 140 is illustrated. As shown, the third embodiment fuel source shaving device 140 can include components similar to the first and second embodiment fuel source shaving devices 100, 120.

The third embodiment fuel source shaving device 140 can include, but is not limited to, a housing 142, a cone shaped aperture (or bore) 144, and a blade 146 having a serrated edge. In one embodiment, the serrated edge can be substantially similar to a file. The device 140 may further include a slot 148 proximate the blade 146 to allow for shaved material to exit the housing 142. In one embodiment, the blade 146 may be removably coupled to the housing 142 via a fastener 147. For instance, a screw may be implemented to removably couple the blade 146 to the housing 142. As shown, the housing 142 can have a substantially cylindrical shape and can include a ridged surface 141 for gripping the fuel source shaving device 140. In one embodiment, a distal end of the housing 142 can be threaded to couple to another housing.

Typically, the third embodiment fuel source shaving device 140 can be implemented to create fine shavings, powder, and/or slivered pieces of material. In one embodiment, the third embodiment fuel source shaving device 140 can be implemented with a rod comprised of magnesium.

Figure 3B:
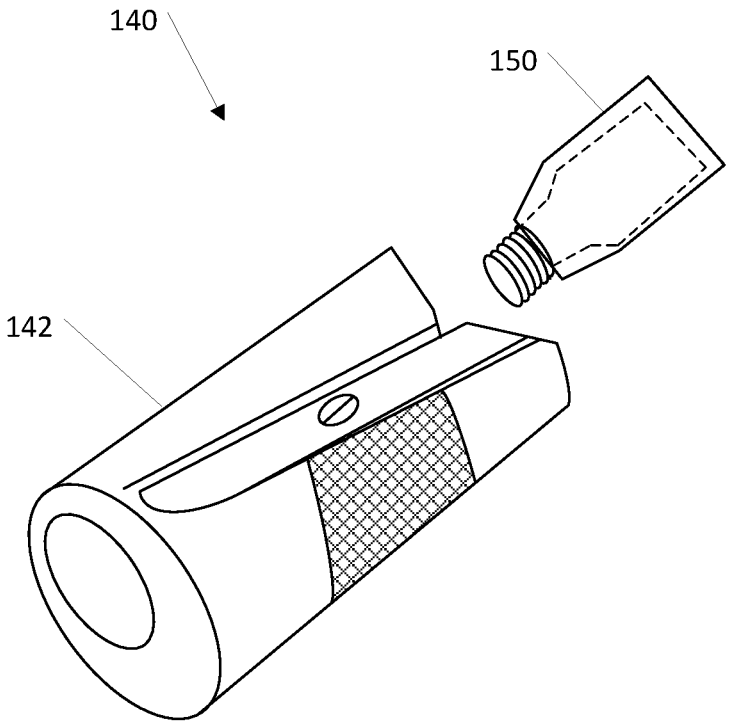
FIG. 3B is a perspective view of a fuel source shaving device according to one embodiment of the present invention.
Figure 3C:
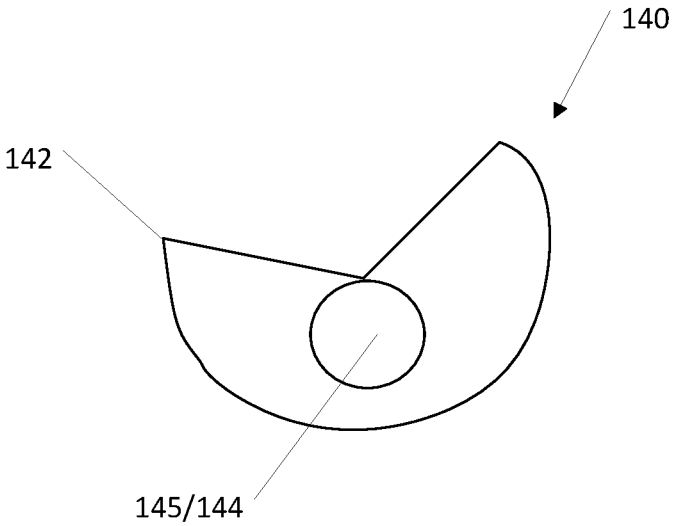
FIG. 3C is a back view of a fuel source shaving device according to one embodiment of the present invention.

Referring to FIG. 3B, a detailed diagram of the third embodiment device 140 including a collection chamber 150 is illustrated. In one embodiment, the third embodiment fuel source shaving device 140 may further include the collection chamber 150. The collection chamber 150 can be configured to capture and store particles, shavings, etc. from the device 140. In one instance, the cone shaped bore 144 may pass through the entire housing 142 and include an opening 145 on an opposite (or distal) side to the circular opening 143, as shown in FIG. 3C. The collection chamber 150 can be configured to capture material exiting from the second opening 145. For instance, the collection chamber 150 may threadably couple to the second opening 145 of the device 140. In one example, the collection chamber 150 may frictionally couple to the second opening 145. In another instance, the collection chamber 150 can be configured to capture material exiting the slot 148 running proximate the blade 146. In yet another instance, the collection chamber can be configured to capture material from proximate the blade 146 and the second opening 145.

Figure 4:
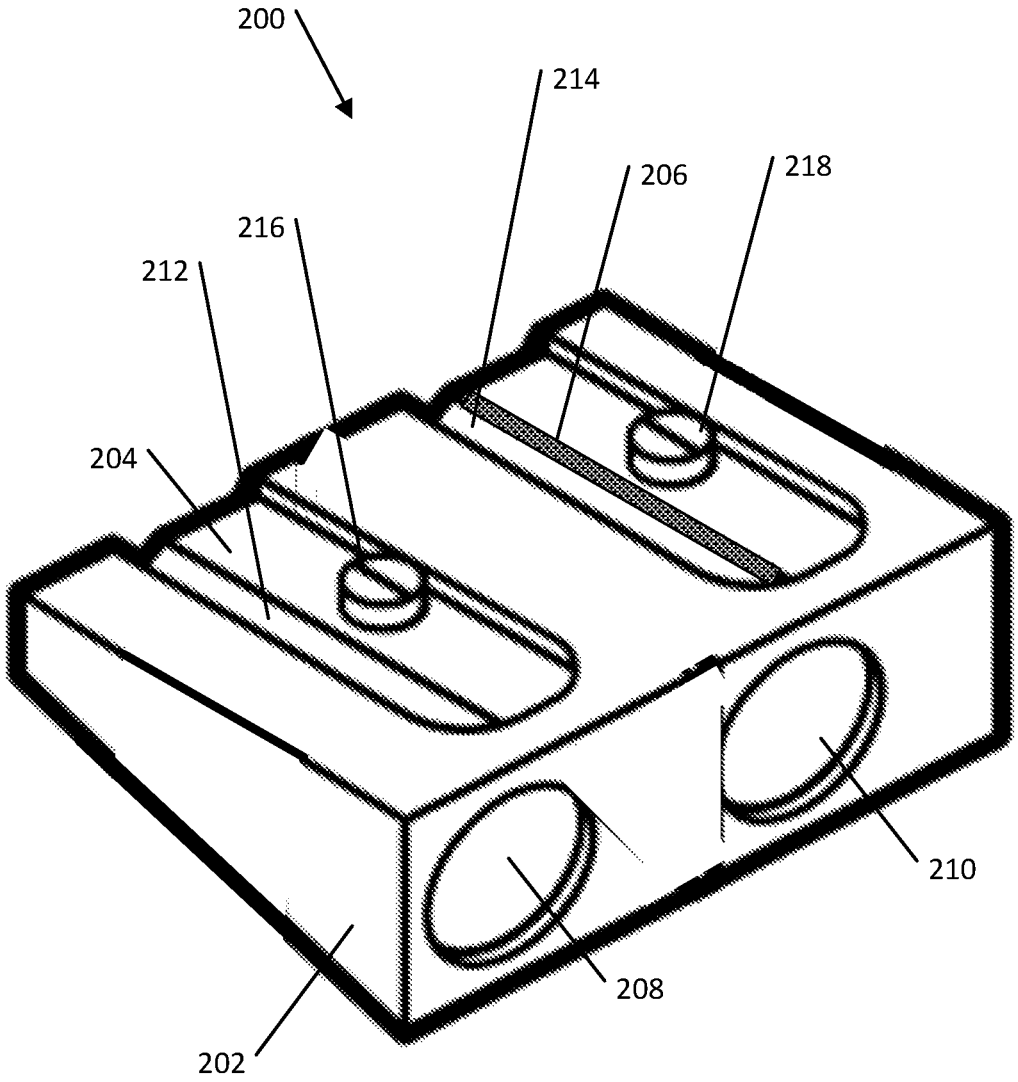
FIG. 4 is a perspective view of a fuel source shaving device according to one embodiment of the present invention.

Referring to FIG. 4, a fourth embodiment 200 of a fuel source shaving device is illustrated. As shown, the fourth embodiment fuel source shaving device 200 can include two steel hardened blades.

In one embodiment, the fuel source shaving device 200 can include a housing 202, a first blade 204, a second blade 206, a first cone shaped bore 208, and a second cone shaped bore 210. Typically, the first blade 204 can be a standard hardened steel blade and the second blade 206 a hardened steel blade having a serrated edge or surface can be implemented. In one instance, a ferrocerium rod can be implemented with the first blade 204 and a magnesium rod can be implemented with the second blade 206.

The device 200 may further include a first slot 212 located proximate the first blade 204 and a second slot 214 located proximate the second blade 206 to allow for shaved material to exit the housing 202. In one embodiment, the first blade 204 and the second blade 206 may each be removably coupled to the housing 202 via a first fastener 216 and a second fastener 218, respectively. For instance, a screw may be implemented to removably couple the blades 204, 206 to the housing 202.

As can be appreciated, in a survival situation, a user would be able to create a fuel plus tinder combination/integration using any of the previously mentioned fuel source shaving devices 100, 120, 140, 200. For example, heat and a stage 1 fuel source can be integrated together instead of being a separate part of the fire triangle. Ferrocerium rods and magnesium rods are conventionally used for the heat portion of the fire triangle and not necessarily the fuel portion. For instance, a fuel procurement device can provide the fuel and the ferrocerium rod provides the ignition/heat source. Any of the previously mentioned fuel source shaving devices 100, 120, 140, 200 can be implemented to merge a fuel source and a heat source by shaving ribbons of material from the ferrocerium rod that may work as the fuel and then the ferrocerium rod can be implemented normally to act as the heat.

Described hereinafter is one example method of implementing the previously described fuel source shaving devices 100, 120, 140, 200. Of note, each of the fuel source shaving devices 100, 120, 140, 200 can be implemented in the described method.

In a first step, a user can provide a fuel source rod and a fuel source shaving device. In one example, the fuel source rod can be a ferrocerium rod. When using a ferrocerium rod, the fuel source shaving device can be implemented to create ribbons of ferrocerium. In another example, the fuel source rod can be a magnesium rod. When using the magnesium rod, the fuel source shaving device can be implemented to create fine shavings of magnesium.

In a second step, the user can insert the fuel source rod into the cone shaped bore as far as the rod will go. Of note, the opening of the fuel source device can be sized to receive the rod.

In a third step, the user can hold the fuel source shaving device static and rotate the fuel source rod. As can be appreciated, as the fuel source rod is rotated, the blade of the fuel source shaving device can interact with the fuel source rod and shave a layer of material from the rod creating ribbons of material made from the fuel source rod. The ribbon of material may then exit through the slot along a length of the blade as the fuel source rod is rotated. Of note, the fuel source rod may be held static and the fuel source shaving device rotated to shave ribbons of material from the fuel source rod. Further noted, the fuel source shaving device can be rotated in an opposite direction of the fuel source rod being rotated in which both components are not static.

In a fourth step, the user can place the ribbon(s) of material proximate or into a burn pile.

In a fifth step, when the user is ready to start a fire, the user can ignite the ribbons of material from the fuel source rod to create a sustained burn of approximately 10-15 seconds. In one example, sparks can be implemented to ignite the ribbons of material.

Embodiment of a Fuel Source Shaving Device Kit

Figure 5:
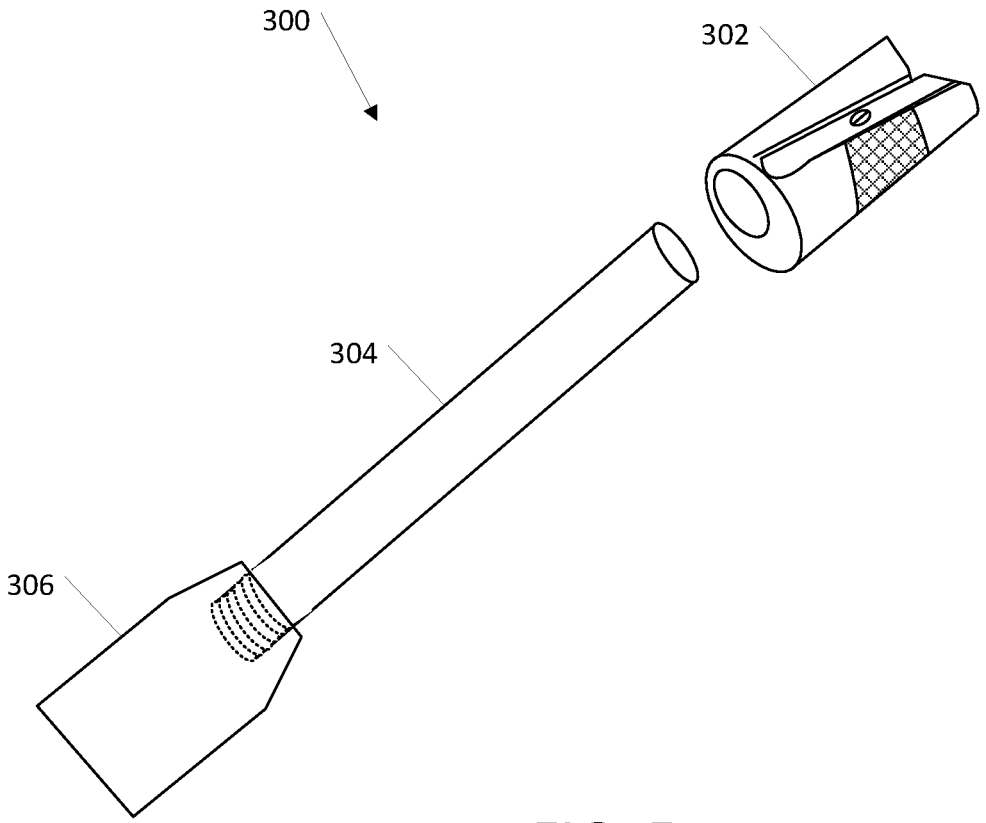
FIG. 5 is a side view of a fuel source shaving device kit according to one embodiment of the present invention.

Referring to FIG. 5, an embodiment 300 of a fuel source shaving device kit is illustrated.

Typically, the fuel source shaving device kit 300 can include, but is not limited to, a fuel source shaving device 302, a fuel source rod 304, and a housing 306. Generally, the fuel source shaving device 302 can be substantially similar to one of the previously described fuel source shaving devices 100, 120, 140, 200. Typically, a first end of the fuel source rod 304 can be threadably coupled to the kit housing 306. In some embodiments, the fuel source shaving device 302 can threadably couple to the kit housing 306. For instance, the fuel source rod 304 can couple to a first end of the housing 306 and the fuel source shaving device 302 can couple to a second end of the housing 306.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A method of implementing a device for shaving a ferrocerium rod, the method comprising:
- providing the device, the device including:
  - a housing;
  - a substantially cylindrical bore in the housing;
  - a hardened steel blade coupled to the housing, an edge of the hardened steel blade projecting into the substantially cylindrical bore;
- inserting a ferrocerium rod into the substantially cylindrical bore;
- rotating the ferrocerium rod causing the hardened steel blade to interface with the ferrocerium rod;
- creating at least one ribbon of ferrocerium;
- using the at least one ribbon of ferrocerium as a fuel source to start a fire; and
- striking the ferrocerium rod to ignite the at least one ribbon of ferrocerium.

2. The method of claim 1, wherein the housing includes a slot located proximate to and along a length of the hardened steel blade.

3. The method of claim 1, wherein the at least one ribbon of ferrocerium is configured to exit the housing via the slot.

4. The method of claim 1, wherein the hardened steel blade is removably coupled to the housing.

5. A method of implementing a device for shaving a magnesium rod, the method comprising:
- providing the device, the device including:
  - a housing;
  - a substantially cylindrical bore in the housing;
  - a hardened steel blade having a serrated edge coupled to the housing, wherein the serrated edge of the hardened steel blade projects into the substantially cylindrical bore;
- inserting a magnesium rod into the substantially cylindrical bore;
- rotating the magnesium rod causing the serrated edge of the hardened steel blade to interface with the magnesium rod;
- creating fine shavings of magnesium;
- using the fine shavings of magnesium as a fuel source to start a fire; and
- striking the magnesium rod to ignite the fine shavings of magnesium.

6. The method of claim 5, wherein the substantially cylindrical bore extends through the housing and includes a first opening and a second opening.

7. The method of claim 6, wherein the fine shavings of magnesium are adapted to exit the housing via the second opening.

8. The method of claim 7, wherein the device for includes a collection chamber configured to collect the fine shavings of magnesium from the second opening.

9. A method of implementing a device for shaving a magnesium rod, the method comprising:
- providing the device, the device including:
  - a housing;
  - a first substantially cylindrical bore in the housing;
  - a first hardened steel blade having a serrated edge coupled to the housing, wherein the serrated edge of the hardened steel blade projects into the first substantially cylindrical bore;
  - a second substantially cylindrical bore in the housing;
  - a second hardened steel blade coupled to the housing, wherein an edge of the hardened steel blade projects into the second substantially cylindrical bore;
- inserting a magnesium rod into the first substantially cylindrical bore;
- rotating the magnesium rod causing the serrated edge of the hardened steel blade to interface with the magnesium rod;
- creating fine shavings of magnesium;
- inserting a ferrocerium rod into the second substantially cylindrical bore;
- rotating the ferrocerium rod causing the hardened steel blade to interface with the ferrocerium rod;
- creating at least one ribbon of ferrocerium;
- using the fine shavings of magnesium and the at least one ribbon of ferrocerium as a fuel source to start a fire; and
- striking the ferrocerium rod to ignite the at least one ribbon of ferrocerium and the at least one ribbon of ferrocerium.

* * * * *